United States Patent [19]

Jönsson et al.

[11] Patent Number: 4,496,920

[45] Date of Patent: Jan. 29, 1985

[54] ELECTROMAGNETICALLY OPERATED ELECTRIC SWITCH

[75] Inventors: Karl E. Jönsson; Gösta Lindgren, both of Västerås, Sweden

[73] Assignee: Asea Aktiebolag, Västerås, Sweden

[21] Appl. No.: 482,020

[22] Filed: Apr. 4, 1983

[30] Foreign Application Priority Data

Apr. 6, 1982 [SE] Sweden ..... 8202209
Apr. 6, 1982 [SE] Sweden ..... 8202210

[51] Int. Cl.[3] ..... H01H 15/00

[52] U.S. Cl. ..... 335/201; 335/192; 200/16 A; 200/243

[58] Field of Search ..... 335/16, 131, 132, 192, 335/195, 198, 201, 274; 200/16 A, 146 R, 243

[56] References Cited

U.S. PATENT DOCUMENTS 3,873,952 3/1975 Kondo et al. ..... 335/192
4,421,959 12/1983 Chen et al. ..... 335/201

*Primary Examiner*—Thomas H. Tarcza
*Assistant Examiner*—George Andrews
*Attorney, Agent, or Firm*—Watson, Cole, Grindle & Watson

[57] ABSTRACT

A contactor has a movable contact assembly which is connected to the magnet armature in such a way that the contact assembly moves translatorily in the same direction as the armature between a closed and an open position. The contact assembly comprises a movable main contact with relatively small contact elements of silver alloy and a movable arcing contact with contact elements of silver-free material. The arcing contact makes and breaks the main current, whereas the main contact carries almost the entire current in closed position. The contacts have separate contact pressure springs. The contactor has at least one opening spring which is obliquely directed in relation to the direction of motion of the armature and is clamped between two bearing points, of which one is fixed whereas the other, upon operation of the electric switch, is displaced together with the armature in the same direction of motion. Thereby, the component of the spring force which counteracts the attractive force of the magnet will be reduced upon closing, which means that, despite double contact and spring systems, it is possible to use an operating magnet with relatively small dimensions.

10 Claims, 4 Drawing Figures

ELECTROMAGNETICALLY OPERATED ELECTRIC SWITCH

BACKGROUND OF THE INVENTION

1. Field of the Invention

The present invention relates to an electromagnetically operated electric switch, for example a contactor, comprising an operating magnet, the armature of which, upon operation of the switch, performs a translatory movement. The armature is connected to the movable contact assembly of the electric switch in such a way that the contact assembly moves in the same direction as the armature between a closed and an open position.

2. Prior Art

Normally, the contact assemblies of large contactors are designed with a movable main contact and one or more fixed main contacts in each phase. To reduce the risk of contact welding and increase the life of the contacts, the contacts are normally provided with contact elements of some silver alloy, for example silver cadmium oxide. Silver alloys are expensive materials, and the cost of said contact elements constitutes a not insignificant part of the price of a contactor. It is therefore desirable to reduce the required amount of silver.

In prior art contactors, it has been proposed to use separate movable main contacts and arcing contacts with separate spring systems (see e.g. German Auslegeschrift No. 1 237 667 and French patent specification No. 1 431 326). In such a design, the arcing contacts make and break the main current, whereas the main contact for the most part carries the current in closed position. A drawback in connection with the proposed contactors with double contacts is, however, that they require a relatively great operating power for the closing operation, since prior art contactors of this kind are provided with helical type opening springs, which are disposed in the direction of movement of the magnet armature. These springs are arranged to influence directly a contact carrier, fixed to the magnet armature, with a returning force acting against the attractive force of the magnet. Upon closing of such a contactor, the opening springs are compressed, the counter force from the springs thus increasing with reduced magnet air gap. Since the operating magnet at the final stage of the closing must also overcome the counter force from the contact pressure springs, it is necessary to use, in such a design, a relatively strong operating magnet. This has an adverse effect on the dimensions, price and power consumption of the contactor.

It is also known (for example, from German Auslegeschrift No. 1 140 263 and U.S. patent specification No. 3,873,952), in a contactor with a conventional contact system, to arrange its opening springs in such a way that the returning force emanating from the springs is reduced upon closing.

SUMMARY OF THE INVENTION

The object of the present invention is to be able to reduce, in an electromagnetically operated electric switch, the required amount of silver in the contact system without simultaneously having to increase the dimensions of the electric switch. According to the invention, this is achieved by a combination of (a) a contact system with one movable main contact and one movable arcing contact, which are influenced by different contact pressure springs, and (b) a magnet system with a so-called degressive opening spring.

By using separate movable main contacts and arcing contacts with separate spring systems, where the arcing contact makes and breaks the main current whereas the main contact for the predominant part, for example to about 95%, carries the current in closed position, the contact elements of the arcing contacts may consist of a silver-free material, for example copper cadmium oxide or copper-tungsten, and only the main contacts need be provided with contact elements of silver-containing material. Since the main contacts make and open in an approximately arc-free manner, the contact wear on these contacts is small and therefore the contact elements may be relatively small. The total silver content in such a contactor can therefore be reduced considerably. In addition, by using an opening spring with a negative force characteristic, the advantage is obtained that—despite double contact and spring systems—it is sufficient with an operating magnet with relatively small dimensions without reducing the demand for reliable closing in one stage. This results in lower costs and lower power consumption.

BRIEF DESCRIPTION OF THE DRAWINGS

The invention will be described in greater detail with reference to an embodiment shown on the accompanying drawing, wherein.

DESCRIPTION OF THE PREFERRED EMBODIMENT

Figure 1:
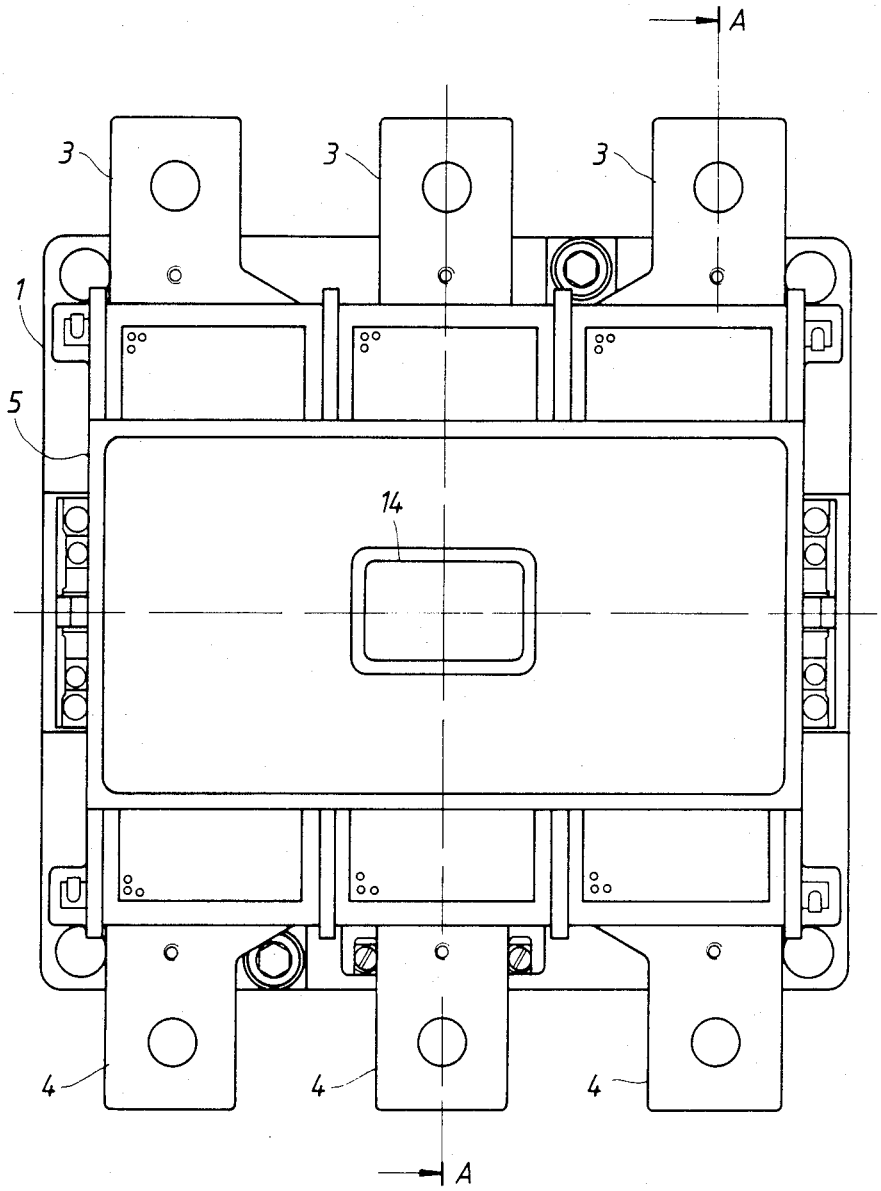
FIG. 1 shows a front view of a contactor constructed according to the invention.

The contactor shown in the drawing has three poles and has a rated voltage of, for example, 660 V. The rated current of the contactor may, for example, be in the range of from 40 to 800 A. The contactor is built up on a stand 1 of pressure-cast light metal. The stand supports a plastic holder 2 with connection bars 3, 4 for connecting the contactor into an external main circuit.

Figure 2:
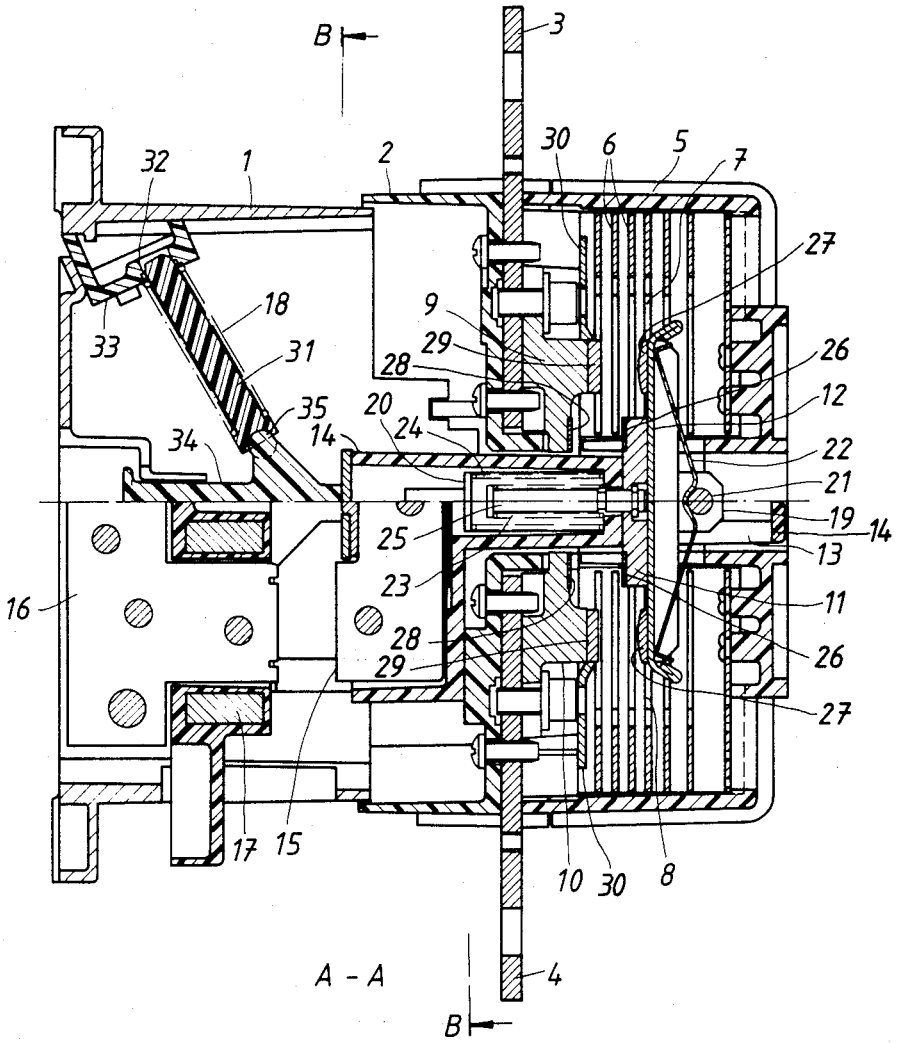
FIG. 2 shows a section through the contactor along the line A—A in FIG. 1.
Figure 4:
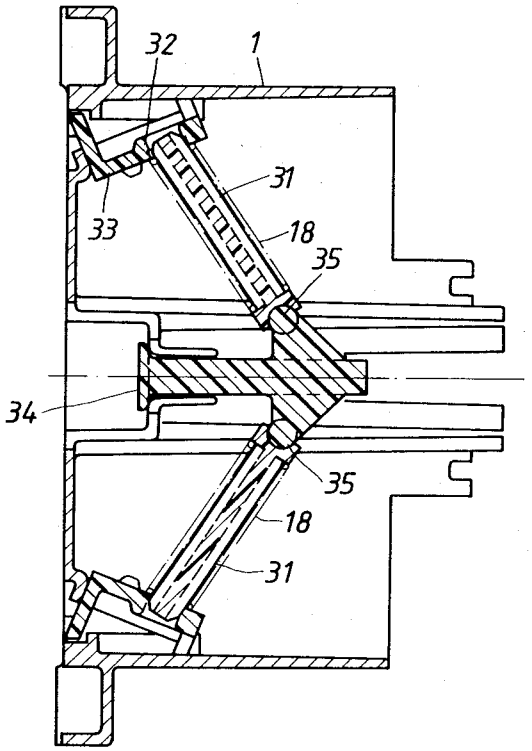
FIG. 4 shows a section through the stand of the contactor along the line C—C in FIG. 3.
Figure 3:
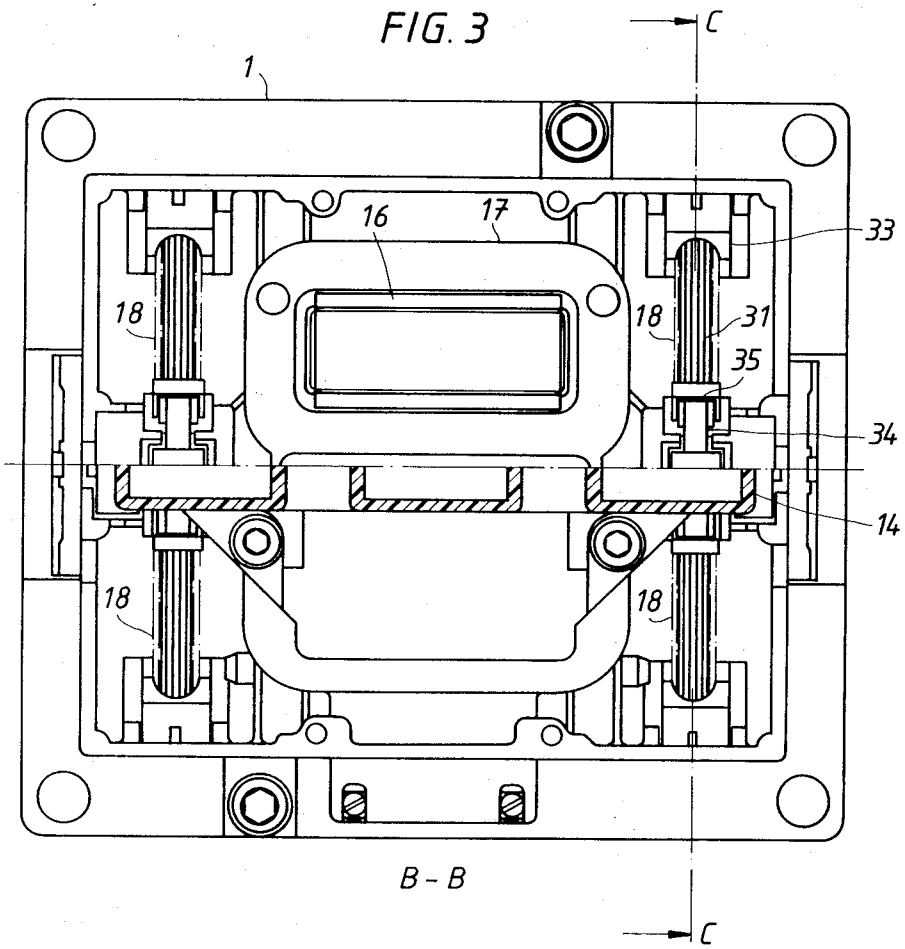
FIG. 3 shows a section through the contactor along the line B—B in FIG. 2.

The contact assembly of the contactor, shown in the open position on the drawing, is surrounded by an arc chute 5 of plastics material (FIG. 2) provided with arc extinction plates 6. The contact assembly comprises in each pole two electrically series-connected breaks which are arranged in respective breaking chambers 7, 8 formed in the arc chute. Each break has a fixed contact 9 and 10, respectively, which is attached to the connection bar 3 and 4, respectively. In closed contact position, the fixed contacts are connected to each other by a bridge contact assembly, which comprises a movable main contact 11 and a movable arcing contact 12. The bridge contact assembly is mounted in an opening 13 of a contact carrier 14 which is connected to the armature 15 of the operating magnet of the contactor, the magnetic core and coil of which are designated 16 and 17, respectively. The armature 15 is influenced by four opening springs 18 (FIGS. 2–4). When the coil 17 is nonenergized, these springs press the armature 15 to the position shown on FIG. 2. The bridge contact assembly 11, 12 passes between the legs 19 of a U-formed yoke 20, which is axially movable in the contact carrier 14. The free ends of the yoke legs 19 are interconnected through a pin 21. Between this pin and the movable arcing contact 12 there is a leaf spring 22.

In the yoke 20, two contact pressure springs 23, 24 in the form of helical springs having different diameters are coaxially arranged. The spring 23, which has the smaller diameter, is connected to the movable main contact 11 via a centrally arranged pin 25, whereas the larger spring 24 influences the movable arcing contact 12 via the yoke 20, the pin 21 and the leak spring 22.

The movable contact 11 may suitable be made of, for example, copper and provided with a contact element 26 of silver alloy, for example silver-cadmium oxide, at either end to carry out the electrical contact function.

The movable arcing contact 12 may suitably be made of, for example, steel and provided with a contact element 27 of silver-free contact material, for example copper-cadmium oxide or copper-tungsten, at either end.

The fixed contacts 9, 10 may suitably be made of copper and be provided each with two contact elements 28, 29 arranged in different planes. The contact elements 28 are arranged to cooperate with the contact element 26 of the movable main contact 11 and are made of the same silver alloy as these. The other contact elements 29 of the fixed contacts cooperate with the contact elements 27 of the arcing contact 12 and are made of the same silver-free material as these. The fixed contacts 9, 10 are further provided with arc horns 30.

The opening springs 18 (FIGS. 2–4) are helical springs mounted on individual supporting pins 31, which are obliquely directed in relation to the direction of movement of the contact carrier 14. At one end the pin 31 is guided in a hole 32 in a bearing housing 33 and at its other end rotatably journalled at a bearing point 35 on a returning pin 34. The supporting pin 31 is pressed against the bearing point 35 by the spring 18, which rests against the bearing housing 33 and, via the pins 31 and 34, influences the contact carrier 14 in a contact-opening direction. The contactor has two returning pins 34 arranged on one side each of the operating magnet 16, 17. Each such returning pin is influenced by two opening springs 18 (FIG. 4), arranged in V-form, which are arranged on opposite sides of the pin 34.

Upon closing of the contactor, the attractive force of the magnet increases as the magnet air gap decreases. During the first part of the closing operation, the magnetic force is counteracted only by the opening springs 18, the angular position of which is changed as the returning pins 34 are being displaced, whereby the component of the spring force which counteracts the magnetic force is reduced. The movable contact assembly will thereby be rapidly accelerated. At the final stage of the closing operation, the total counter force is increased intermittently in two stages when first the contact making of the arcing contacts 12 and thereafter the contact making of the main contacts 11 occurs. Thus, in addition to the counter force from the opening springs 18, the magnet also has to overcome the counter forces from the contact pressure springs 24 and 23. However, since in this position the counter force of the opening springs is smaller than in the open position of the contactor, it is sufficient to have a lower magnetic attractive force and thus a smaller contactor magnet than with a conventional spring arrangement.

Upon closing, the arcing contact breaks 27, 29 make before the main contact breaks 26, 28, whereas upon opening the arcing contact breaks open after the main contact breaks. In this way, the advantage is obtained that the main contacts make and open in an approximately arc-free manner, whereby the wear on these contacts is low. Therefore, the contact elements 26, 28 can be small, for example smaller than one-third of the volume of the contact elements 27, 29 of the arcing contacts. Thus, the necessary amount of silver is relatively small, which means that the cost of the contact can be considerably reduced.

I claim:

1. An electromagnetically operated electric switch comprising a first fixed contact (9), a second fixed contact (10) being disposed at a distance from said first contact, a movable bridge contact assembly (11, 12) for connecting said first and second fixed contacts, said bridge contact assembly comprising a movable main contact (11) and a movable arcing contact (12), said movable main and arcing contacts being subjected to separate contact pressure springs (23, 24), electromagnetic means controlling engagement of said bridge contact assembly with said fixed contacts, said electromagnetic means comprising an electromagnet (16, 17) with an armature (15), and means (14) mechanically connecting said armature to said bridge contact assembly for moving said contact assembly in the same direction as the armature between a closed and an open contact position, at least one elongated opening spring (18) permanently subjecting said armature to a returning biasing force effective in the opposite direction of the attractive force of the electromagnet, said opening spring being mounted with its longitidinal axis inclined in relation to the direction of motion of the armature between a first bearing (33), which is fixed, and a second bearing (35) which is displaced together with and in the same direction as the armature, whereby the angle between the longitudinal axis of the spring and the direction of motion of the armature is changed in such a way that said returning force of the opening spring decreases upon attraction of said armature.

2. Switch according to claim 1, wherein the movable arcing contact (12) is longer than the movable main contact (11), and that these contacts (11, 12) are arranged in parallel adjacent to each others, so that the arcing contact (12) projects outside the two ends of the main contact (11), and are provided with contact elements (26, 27) of different contact material, and that each one of the fixed contacts (9, 10) is provided with two contact elements (28, 29), arranged in different planes, of different contact materials corresponding to the contact elements (26, 27) of the movable contacts (11, 12).

3. Switch according to claim 2, wherein the volume of the contact elements (26) of the main contact is smaller than one-third of the volume of the contact elements (27) of the arcing contact, and that the contact elements (26) of the main contact consist of a silver alloy, whereas the contact elements (27) of the arcing contact consist of a silver-free material.

4. Switch according to claim 1, wherein the bridge contact assembly (11, 12) and the armature (15) are arranged on one side each of the fixed contacts (9, 10) and connected to each other by a linearly displaceable contact carrier (14) arranged between the fixed contacts, and the contact pressure springs (23, 24) are coaxially arranged helical springs of different diameters, which are arranged inside the contact carrier (14).

5. Switch according to claim 4, wherein the spring (23) with the smaller diameter is connected to the movable main contact (11) by a centrally arranged pin (25) whereas the spring (24) with the larger diameter is connected to the movable arcing contact (12) via a yoke (20) surrounding the bridge contact assembly (11, 12).

6. Switch according to claim 1, wherein the opening spring (18) is a helical spring which is provided with a supporting pin (31) surrounded by the spring (18), which supporting pin, at the fixed bearing point (33) of the spring, runs in a guide bearing (32) and, at the displaceable bearing point (35) of the spring, is provided with a rotating bearing, whereby the supporting pin (31) is arranged to be pressed axially by the spring (18) in a direction towards said rotating bearing (35).

7. Switch according to claim 1, wherein the displaceable bearing point (35) of the spring (18) is arranged on a returning pin (34) displaceably arranged in the direction of motion of the armature (15).

8. Switch according to claim 7, wherein the returning pin (34) is influenced by two opening springs (18), arranged in a V-form on opposite sides of the pin (34).

9. Switch according to claim 8, wherein the returning pin (34) is pressed by the opening springs (18) towards the contact carrier (14) connected to the magnet armature.

10. Switch according to claim 8, wherein two returning pins (34), which are each influenced by two opening springs (18), are arranged on one side each of the operating magnet (16, 17).

* * * * *